US006373028B2

(12) United States Patent
Williamson et al.

(10) Patent No.: US 6,373,028 B2
(45) Date of Patent: Apr. 16, 2002

(54) INTERNALLY TEMPERATURE CONTROLLED HEAT BLANKET

(75) Inventors: Mickey A. Williamson, Seattle; John F. Talbot, Lake Stevens; John C. Coles, Seattle, all of WA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/533,441

(22) Filed: Mar. 23, 2000

Related U.S. Application Data

(63) Continuation of application No. 09/305,860, filed on May 5, 1999, which is a continuation-in-part of application No. 08/864,705, filed on May 28, 1997, now abandoned.

(51) Int. Cl.[7] ..... H05B 1/00
(52) U.S. Cl. ..... 219/212; 219/548
(58) Field of Search ..... 219/212, 510, 219/523, 528, 544, 549, 550, 505, 481, 548

(56) References Cited

U.S. PATENT DOCUMENTS 4,177,376 A * 12/1979 Horsma et al. ..... 219/553
4,684,785 A 8/1987 Cole
4,733,057 A 3/1988 Stanzel et al.
4,761,541 A 8/1988 Batliwalla et al.
4,858,853 A 8/1989 Westerman et al.
4,882,016 A 11/1989 Westerman, Jr.
4,916,880 A 4/1990 Westerman, Jr.
4,937,435 A * 6/1990 Goss et al. ..... 219/528
4,987,700 A 1/1991 Westerman et al.
4,988,414 A 1/1991 Westerman, Jr.
5,190,611 A 3/1993 Cologna et al.
5,207,541 A 5/1993 Westerman et al.
5,271,145 A 12/1993 Westerman, Jr. et al.
5,279,725 A 1/1994 Westerman, Jr.
5,442,156 A 8/1995 Westerman et al.
6,084,206 A * 7/2000 Williamson et al. ..... 219/212

* cited by examiner

*Primary Examiner*—Tu Ba Hoang
(74) *Attorney, Agent, or Firm*—Conrad O. Gardner

(57) ABSTRACT

An internally temperature controlled heat blanket. The heat blanket includes an outer layer of protecting foam fiberglass that affords operator safety, a layer of closed cell silicone foam which provides thermal and electrical insulation, a layer of thermally conductive mesh, another layer of thermally conductive silicone with holes cut into it, the holes containing positive temperature coefficient (PTC) heating elements, another layer of conductive mesh, a layer of thermally conductive silicone, and an inner layer of moderately conductive cured silicone or foam.

2 Claims, 6 Drawing Sheets

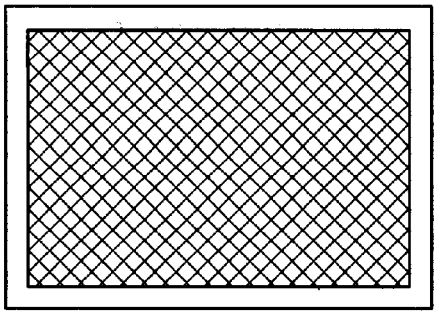
*Fig. 2* AL OR CU MESH (+) OR (-)
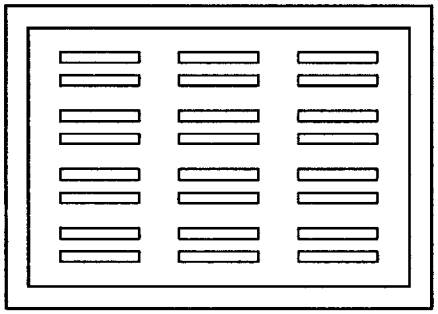
*Fig. 3* CUT OUT "T" GON 210
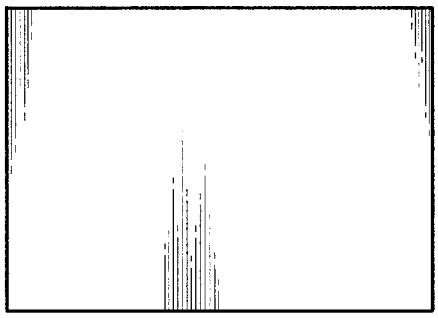
*Fig. 4* "T" PLY 210
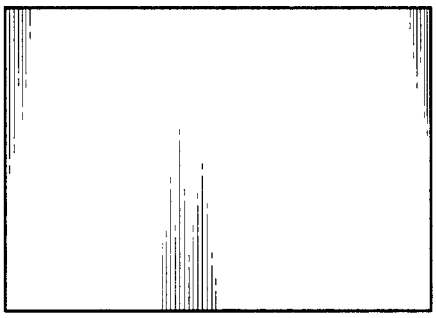
*Fig. 5* FR. 17

INTERNALLY TEMPERATURE CONTROLLED HEAT BLANKET

CROSS-REFERENCE TO RELATED APPLICATIONS

This application is a continuation of prior application No. 09/305,860, filed May 5, 1999, which is a continuation-in-part of prior application No. 08/864,705, filed May 28, 1997 abandoned.

BACKGROUND OF THE INVENTION

1. Field of the Invention

The present invention relates to heat blankets and more particularly to an internally temperature regulated heat blanket.

2. Description of the Prior Art

Heretofore, the problem with existing heat blankets is that they do not provide a safe, uniform temperature when covering non-uniform cold areas or heat sinks having variable heat transfer characteristics. Current blankets generally utilize some form of electrical resistance wire, such as inconel, balco, or nichrome wire as a heating element. Another problem with current blankets is that the wires can be broken during flexing or application of the blanket to existing heaters using a contoured surface.

It is also possible for thermal overshoot (excessive temperature excursions) to occur in the presence of variable heat sinks and high thermally resistant insulation surrounding the heat source. The thermal overshoot is not desired since it can cause damage to the surrounding area or may even destroy composite materials undergoing repair. This problem occurs because the heating element is a high temperature source for the required thermal energy, and during rapid restoration of heat following depletion, the system overshoots the set surface temperature. This can therefore require that resistance wire types of heaters incorporate thermocouples, hot bond regulators, and computers to monitor and control safely the total overall temperature of the blanket.

Other technologies for heat application for composite repair on aircraft can be complex and may include the use of components such as metals excited by high frequency RF, or "loaded" polymers of conductive material that, when similarly energized, provide a given heat for their designed configuration.

The prior art patent literature includes:

U.S. Pat. No. 4,937,435 to Goss et al., which discloses a flexible electric heating pad using positive temperature coefficient (PTC) ceramic thermistor chip heating elements. As shown in FIG. 1, the pad space P has thermistors 10 inserted into separating dielectric insulator 12. Conductive sheets 16 and 18 are provided parallel to each other on opposite sides of the dielectric 12. Insulating layer 20 is provided to protect the heating pad P from the environment. The metallic sheet 22 may be formed over the insulating layer 20. Conductors 17 and 19 can be attached to the conductive sheets 16 and 18.

U.S. Pat. No. 4,177,376 to Horsma et al. (positive temperature coefficient) which illustrates a layered self-regulating heat article in which a PTC layer 49 is provided between a layer of constant wattage material 47 having electrodes 48 embedded therein and a second constant wattage layer 50 with electrodes 51 embedded within. Insulation layers 46 and 53 are provided outside of layers 47 and 50, respectively.

U.S. Pat. No. 4,684,785 to Cole which teaches an electric blanket having a heating element with at least two electrodes separated by a heating material with a positive temperature coefficient of resistance.

U.S. Pat. No. 4,761,541 to Batliwalla et al. which relates to a device comprising conductive polymer compositions and has a laminar PTC conductive polymer element 11 on one surface of an electrode 12. Electrodes 13 and 14 are separated from the electrode 12 by the PTC electrode 11.

U.S. Pat. No. 4,733,057 to Stanzel et al. which teaches a sheet heater which includes multiple self-regulating PTC conductive polymer heater elements which are disposed parallel to one another and held in place by supports of rigid polymeric material such as polyamide.

It is an object of the present invention to overcome the limitations of the prior designs by providing a heat blanket utilizing a plurality of PTC devices arranged to have a high surface area utilization to eliminate hot spots; and which additionally features low thermal resistance transfer paths to prevent overshooting of the intended temperature range.

A design to which the electrical interconnects of the heating element serve also as a heat transfer device which is not found in present blanket construction. The physical arrangement of the electrical interconnects make it possible to repair a defective heating element if necessary rather than rendering the entire blanket defective, which is the case with present blankets.

It is yet another object of the present invention to provide a heat blanket design utilizing positive temperature coefficient devices as stable heating elements which will not overshoot their intended temperature range; which heat blanket may be cut into another geometry without destroying or compromising heat transfer.

SUMMARY OF THE INVENTION

The invention is a heat blanket for cure of composite parts or to other items such as food carts or trays that require stable heat sources and uniform application of heat. The blanket is composed of an outer layer of fiberglass for mechanical protection, a layer of closed cell silicone foam for thermal and electrical insulation, a layer of thermally conductive but electrically insulating silicone product, a layer of electrically conductive mesh, another layer of thermally conductive silicone with holes cut into it in which are placed positive temperature coefficient (PTC) heating elements, another layer of conductive mesh, a layer of thermally conductive silicone and an inner layer of moderately conductive cured silicone or foam. The positive temperature coefficient elements will maintain a constant temperature as long as sufficient current is available. The two layers of conductive mesh form the electrical connections for the heating elements. Optimally, there is a strip of foil around the perimeter of each layer of conductive mesh to provide relatively easy electrical connections. The blanket may be cut to any shape or size, although cutting the (PTC) heating elements is difficult unless they are very thin. The use of PTC heating elements eliminates the need for sophisticated temperature control. In practice, the blanket can maintain 350 degrees Fahrenheit on the inside and still allow physical contact on the outside without burning the operator. The outer layer of the heat blanket is described in Boeing U.S. Pat. No. 5,330,809 and provides a thermal barrier and flame retardant benefits. The flame retardant characteristics of the top layer of foam provides a self-extinguishing feature to a heating element that may destruct in operation by thermal runaway that can cause temperatures to exceed to greater than the design characteristics of the PTC device.

BRIEF DESCRIPTION OF THE DRAWING(S)

FIG. 2 is a plan view of the aluminum mesh position of the heat blanket shown in FIG. 1;

FIG. 3 is a plan view of the "T" GON 210 layer of the heat blanket shown in FIG. 1;

FIG. 4 is a plan view of the "T" ply 210 layer shown in the heat blanket of FIG. 1

Figure 1:
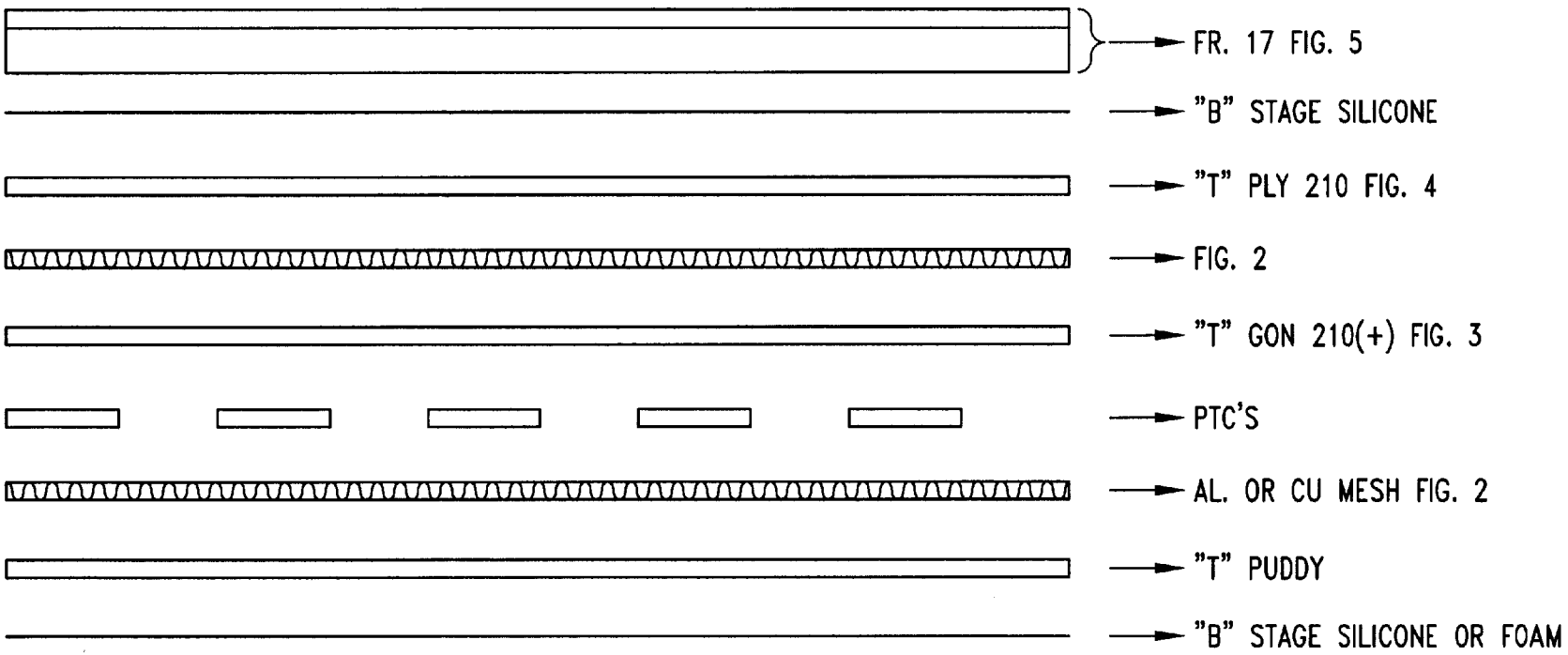
FIG. 1 is an exploded sectional view of a preferred embodiment of the present heat blanket.
Figure 6:
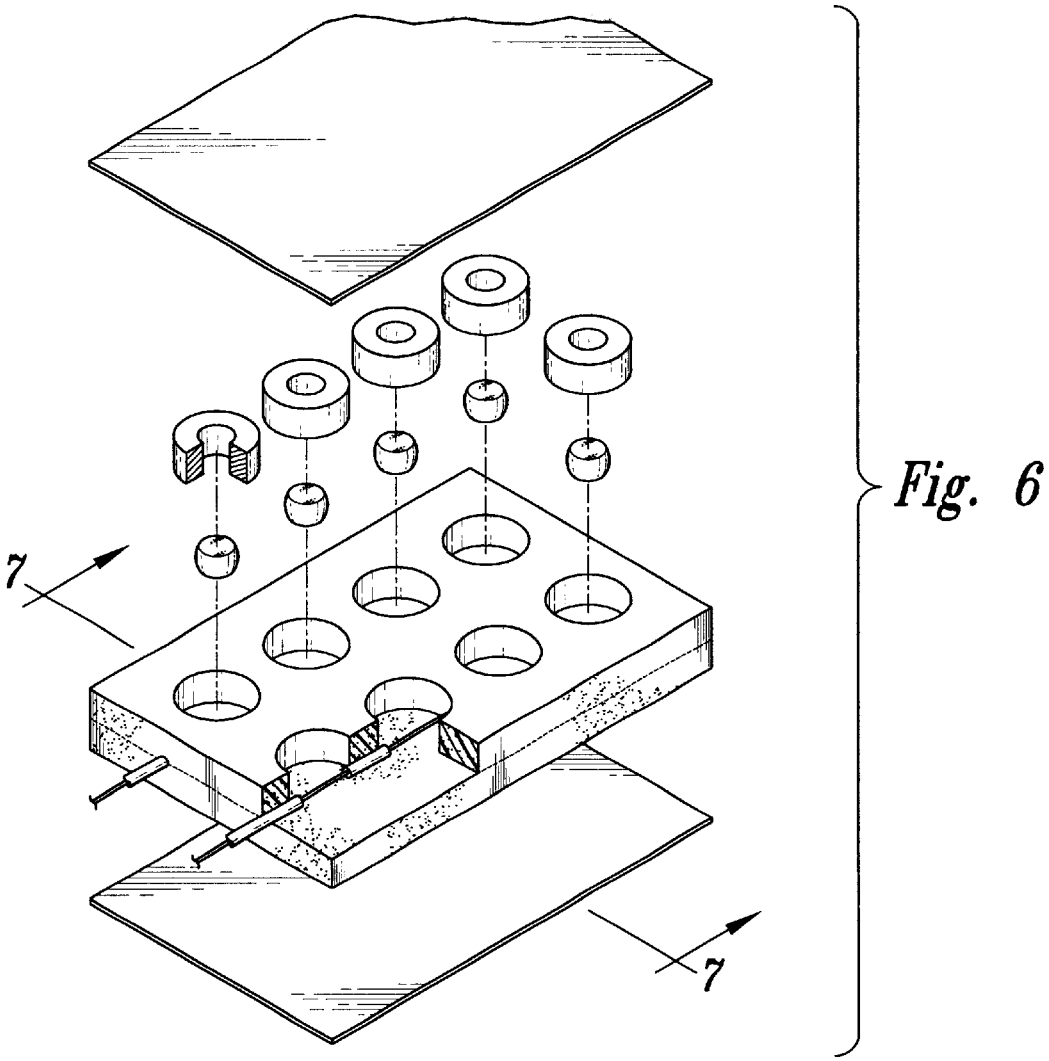
Figure 7:
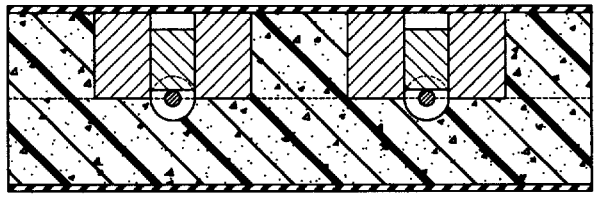
Figure 8:
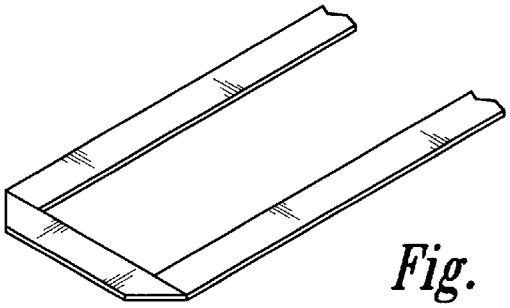
Figure 9:
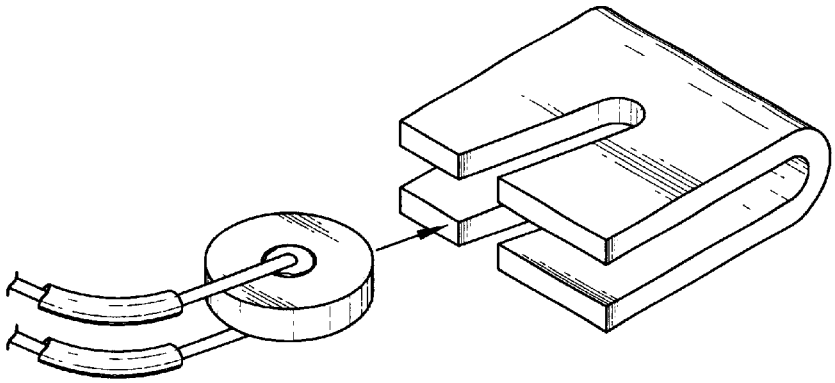
Figure 10:
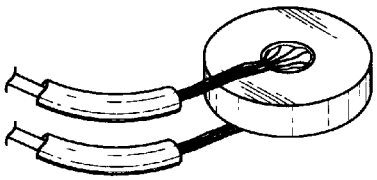
Figure 11:
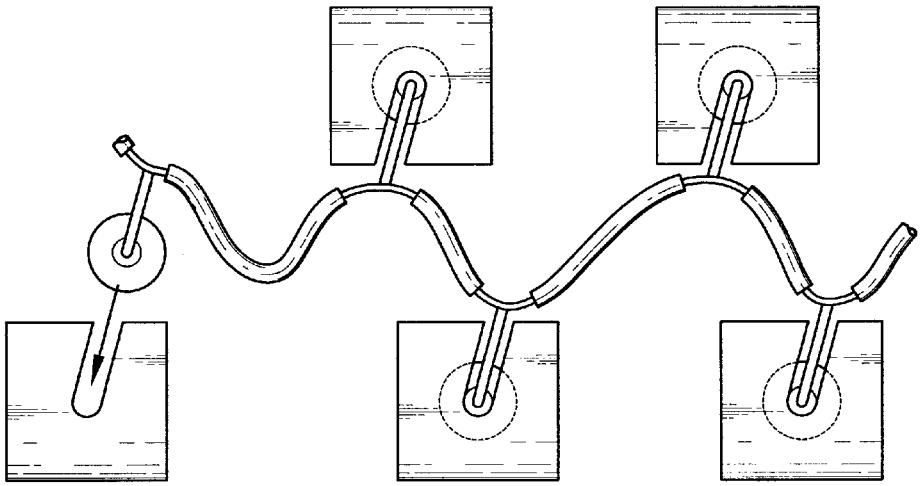
Figure 12:
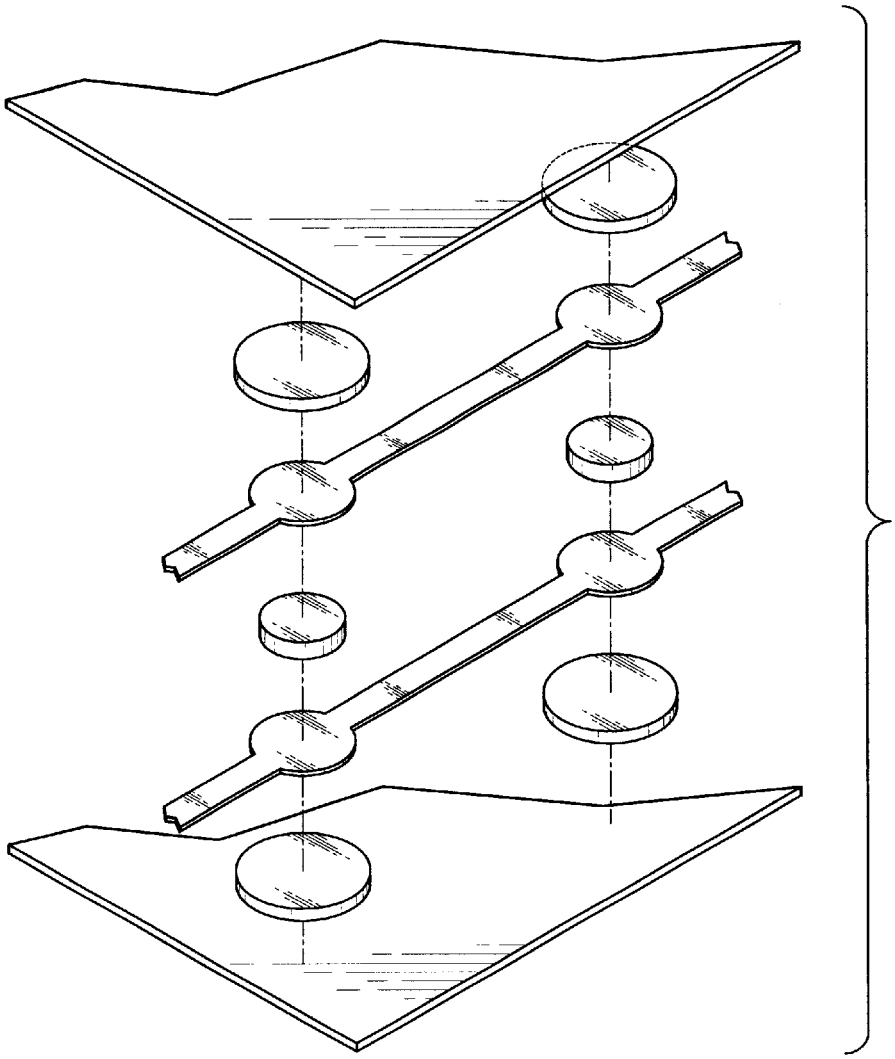
Figure 13:
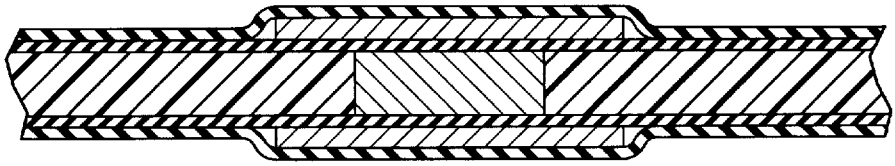
Figure 14:
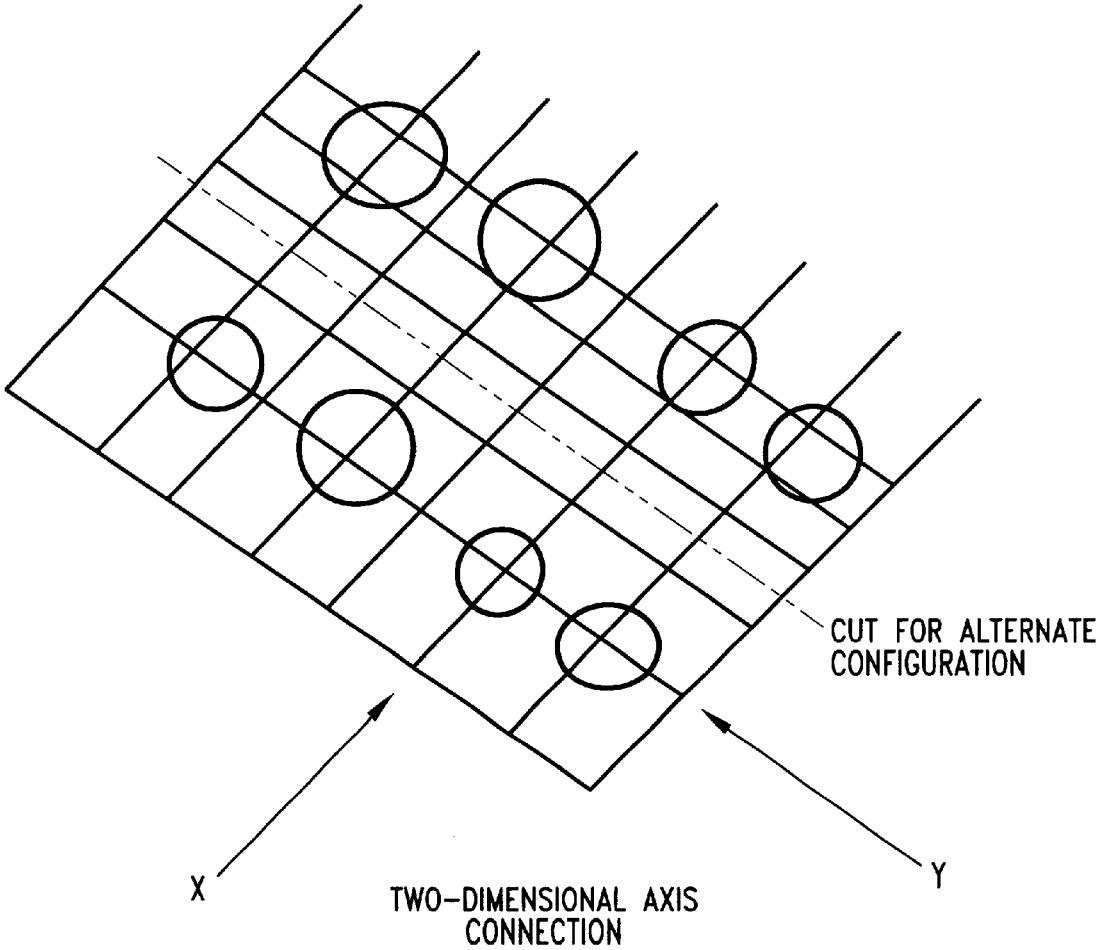

FIG. 5 is a plan view of the FR17 material described in Boeing U.S. Pat. No. 5,330,809 and shown in the heat blanket layered composite structure of FIG. 1;

FIG. 6 is an exploded isometric view of the positive temperature coefficient (PTC) devices which are mounted on a metallic substrate sandwiched in the heat blanket assembly of FIG. 1;

FIG. 7 is a transverse sectional view taken along lines 8—8 of FIG. 6 of the structure containing the positive temperature coefficient (PTC) devices;

FIG. 8 is a fragmentary isometric view of an alternate form of copper conductor useful in the heat blanket of FIG. 1;

FIG. 9 is an exploded isometric view of a PTC element in an alternative electrically insulated heat sink clip configuration useful in the heat blanket of FIG. 1;

FIG. 10 is an exploded isometric view of another copper conductor configuration useful in the heat blanket of FIG. 1;

FIG. 11 is a plan view of a conductor configuration for PTC devices shown in assembled and partly assembled condition;

FIG. 12 is an exploded isometric showing PTC devices and connecting conductor network;

FIG. 13 shows a longitudinal cross-section of the PTC device and conductor assembly as shown in the present electric blanket; and FIG. 14 is an exploded view of FIG. 2 showing the placement of one type of PTC's on a series of parallel copper or aluminum mesh with a dash line showing a cut of the electrical conductor if desired for another configuration.

DESCRIPTION OF A PREFERRED EMBODIMENT

As hereinafter described, it will be seen that recent developments in and availability of heat transfer polymers and thermal barriers have enabled the successful use of PTC devices in the present heat blanket which has the following features and advantages:

1. A blanket constructed with a thermal barrier, operating at 150° F. to 700° F. to the applied component, that can be handled by the top layer of the constructed blanket without harm by an operator.
2. A blanket that can be cut to other geometries and maintain all the thermal qualities of the initial construction.
3. A blanket that does not need an external zone controller and is self controlled.
4. A blanket that does not have thermal overshoot which can damage other closely related parts.
5. A blanket that can be operated from several electrical standard voltages or frequencies, including direct current (dc).
6. A blanket that does not require a series resistive wire-type heater element.
7. A blanket that can limit external thermal loss to less than 1%.
8. A blanket that will not cause any surface contamination.
9. A blanket that will contain and smother any internal flammable combustion.
10. A blanket that meets all environmental requirements and can be used in conjunction with food services, hydrocarbon fluids and space environments.

When a number of PTC devices are placed on a given substrate as hereinafter described, a constant and stable temperature can be maintained with very little thermal loss. When configured for a composite material repair function, the devices can be operated at many different voltages, and temperature variations from 150° F. to 700° F. with the heat flow driven to the part under repair. Thus, the top surface has the capability of being handled by the operator without causing any injury. Because of its inherent internal temperature zone control, the blanket may also be cut to any configuration and still maintain, without thermal overshoot, its heat flow density characteristics and conformability over a wide range of voltage inputs.

The blanket is constructed as described in the following configuration, but is not limited to the thickness and application of the materials, or the thermal surface required. As will become apparent, each application will have to be adjusted to the PTC heat requirement, voltage requirement and power.

The bottom surface, in direct contact with the part under repair, is a silicone ":B" stage elastomer with a fiberglass inner manufactured by Arlon Corporation. The next layer is a thermal transfer putty in an X to Y axis, such as the Thermagon "T" Putty. One or two layers, depending on the need, comprises an aluminum or copper expandable screen or mesh, manufactured by Delker, that provide thermal and electrical conductivity. The PTC's are then placed on the metallic substrate and adhered with the use of a silicone filled silver epoxy, or can be connected by other mechanical means as the application requirement for flexibility is desired. The layer of the PTC's is another layer of thermal polymer, such as the "T" Ply 210 by Thermagon and is cut to allow the PTC to be exposed on the opposite side of the adherence to the inner metallic substrate. The next layer consists of an expandable thermal and electrical conductive screen or mesh and is attached to the PTC's by the adhesive method or mechanical as desired. The next layer of the construction of the blanket is a thermal conductive and electrical insulative material, such as "T" GON (manufactured by Thermagon) or other equivalent sources. The top layer consists of a closed cell silicon foam with a thermal set adhesive on the bottom and a protective silicone fiberglass on top to provide puncture and tear resistance of the blanket. The preferred material is one manufactured by CHR under the part identification of FR 17 as described in Boeing U.S. Pat. No. 5,330,809.

Prior to manufacturing processing of the hereinbefore described blanket, a copper tape is applied to the edge of each metallic substrate and verified that the electrical continuity is within tolerance. This provides assurance that the blanket can be cut into different forms, and by means of an external pigtail secured to the copper conductor, the blanket can still perform to the initial thermal requirements.

What is claimed is:

1. An internally temperature controlled heat blanket, the improvement comprising:

applying current to a plurality of positive temperature coefficient heating elements;

applying said internally controlled heat blanket to a heat sink that is uniform with a given surface area to which the heat blanket is applied; and applying additional current only to individual ones of said plurality of positive temperature coefficient heating elements that are in contact with an excessive heat sink that is not uniform with the remaining surface area to which the internally temperature controlled heat blanket is applied.

2. The invention according to claim 1 wherein applying current to a plurality of positive temperature coefficient heating elements comprises positioning a strip of foil around the perimeter of two layers of conductive mesh for forming the electrical connections to said plurality of positive temperature coefficient heating elements.

* * * * *